US006827471B1

(12) United States Patent
Benghozi

(10) Patent No.: US 6,827,471 B1
(45) **Date of Patent: *Dec. 7, 2004**

(54) RECESSED LIGHT FIXTURE

(75) Inventor: Simon-Victor Benghozi, Outremont (CA)

(73) Assignee: Bazz Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/463,265

(22) Filed: Jun. 17, 2003

(51) Int. Cl.[7] ..... F21S 8/04

(52) U.S. Cl. ..... 362/365; 362/147; 362/366; 362/368

(58) Field of Search ..... 362/147, 148, 362/364, 365, 368; D26/39, 72, 74, 75, 79, 83

(56) References Cited

U.S. PATENT DOCUMENTS 5,377,088 A 12/1994 Lecluze ..... 362/366
5,609,414 A 3/1997 Caluori ..... 362/366
6,554,458 B1 * 4/2003 Benghozi ..... 362/365

FOREIGN PATENT DOCUMENTS

CA 2 355 006 2/2003

* cited by examiner

*Primary Examiner*—John Anthony Ward
(74) *Attorney, Agent, or Firm*—Piper Rudnick LLP

(57) ABSTRACT

A recessed light fixture for mounting into an opening made in a ceiling, wall or the like comprises a pot having a peripheral edge abutting the area adjacent a hole made in the ceiling or wall and one or more flexible retaining clips for securing the fixture to the ceiling, wall or the like. Each retaining clip comprises an upper connecting portion with a threaded hole extending therethrough and a lower action adapted to contact the lower end of a slot in the side wall of the pot. A bolt extends through the threaded hole of the upper connecting portion and its rotation causes the clip to flex and unflex to secure or unsecure contact with the ceiling, wall or the like.

7 Claims, 4 Drawing Sheets

RECESSED LIGHT FIXTURE

FIELD OF THE INVENTION

The present invention relates to light fixtures and, in particular, to a recessed light fixture having one or more adjustable retaining clips for securing the fixture to a ceiling, wall or the like.

BACKGROUND OF THE INVENTION

Recessed light fixtures used in residential and/or commercial premises are well known. They are installed within a ceiling, wall or the like so that only the flange portion of the fixture lies flat with the wall surface. Their aesthetic and functional advantages are also well known; for example, such light fixtures are found described in U.S. Pat. No. 5,377,088 issued Dec. 27, 1994 to Lecluze, U.S. Pat. No. 5,609,414 issued Mar. 11, 1997 to Caluori and Canadian patent application 2,355,006 published Feb. 10, 2003 to Benghozi.

OBJECTS AND STATEMENT OF THE INVENTION

It is an object of the present invention to provide an improved recessed light fixture, also known as pot lights, which is easy to use and which is installed independently of the thickness of the ceiling or wall.

It is also an object of the present invention to provide a recessed light fixture which does not need to be secured to a joist, cross-piece or mounting frame.

This is achieved by providing a recessed light fixture which comprises:

a) a pot adapted to be received in the ceiling or wall opening; the pot having an inner rear wall and a side wall; the side wall having an outer peripheral flange adapted to bear against the front wall surface when mounted in the opening; the side wall displaying slot means therein;

b) retaining clip means consisting of an elongated flexible body having i) a main portion adapted to lie exteriorly along the side wall;

ii) an upper connecting portion extending substantially parallel to the inner rear wall of the pot and through the slot means; the upper connecting portion displaying a threaded hole therethrough;

iii) a lower portion extending through the slot means; the lower portion engaging a lower extremity of the slot means and having a lower edge adapted to contact the side wall of the pot;

c) an adjusting bolt having a head and an elongated threaded stem adapted to extend through the threaded hole of the upper connecting portion of the clip means and to contact the rear wall of the pot:

wherein rotation of the bolt causes the upper connecting portion of the clip means to move longitudinally relative to the side wall in the slot means and the main portion to flexibly bend and unbend in accordance with respective rotational actuation of the bolt to fixedly secure and unsecure the pot in the ceiling, wall or the like.

In one form of the invention, the side-wall of the pot is provided with two vertically aligned slots through which extends upper and lower parts of the clip.

In a preferred form of the invention, a pair of clips are provided in corresponding slots in diametrically opposite sides of the pot.

Other objects and further scope of applicability of the present invention will become apparent from the detailed description given hereinafter. It should be understood however that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

In the appended drawings:

FIG. 3 is a cross-sectional view showing the insertion of the light fixture made in accordance with the present invention in a ceiling, wall or the like;

DESCRIPTION OF THE PREFERRED EMBODIMENT

Figure 1:
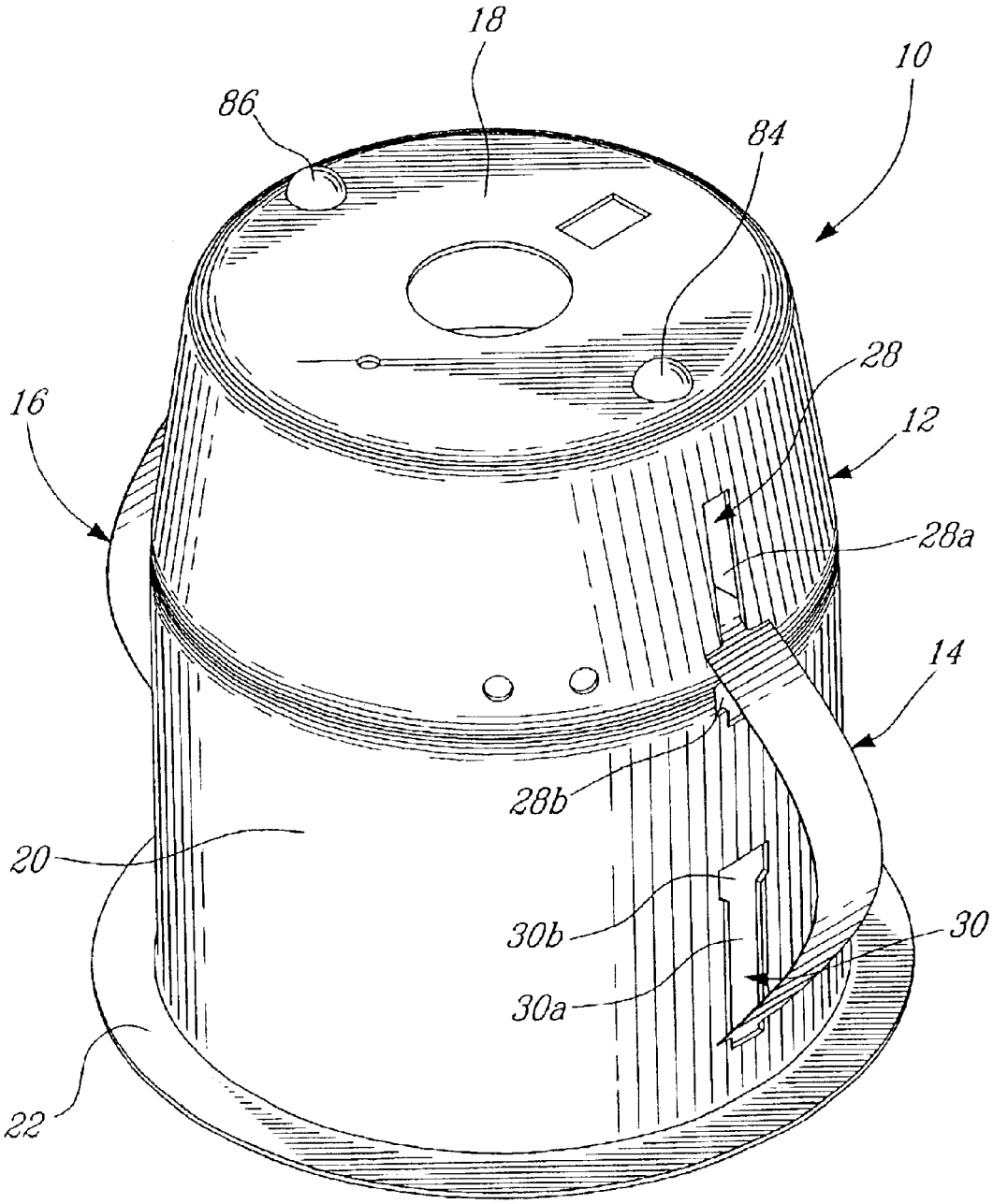
FIG. 1 is a top perspective view of a recessed light fixture made in accordance with the present invention, showing the retaining clip in a flexed condition.
Figure 2:
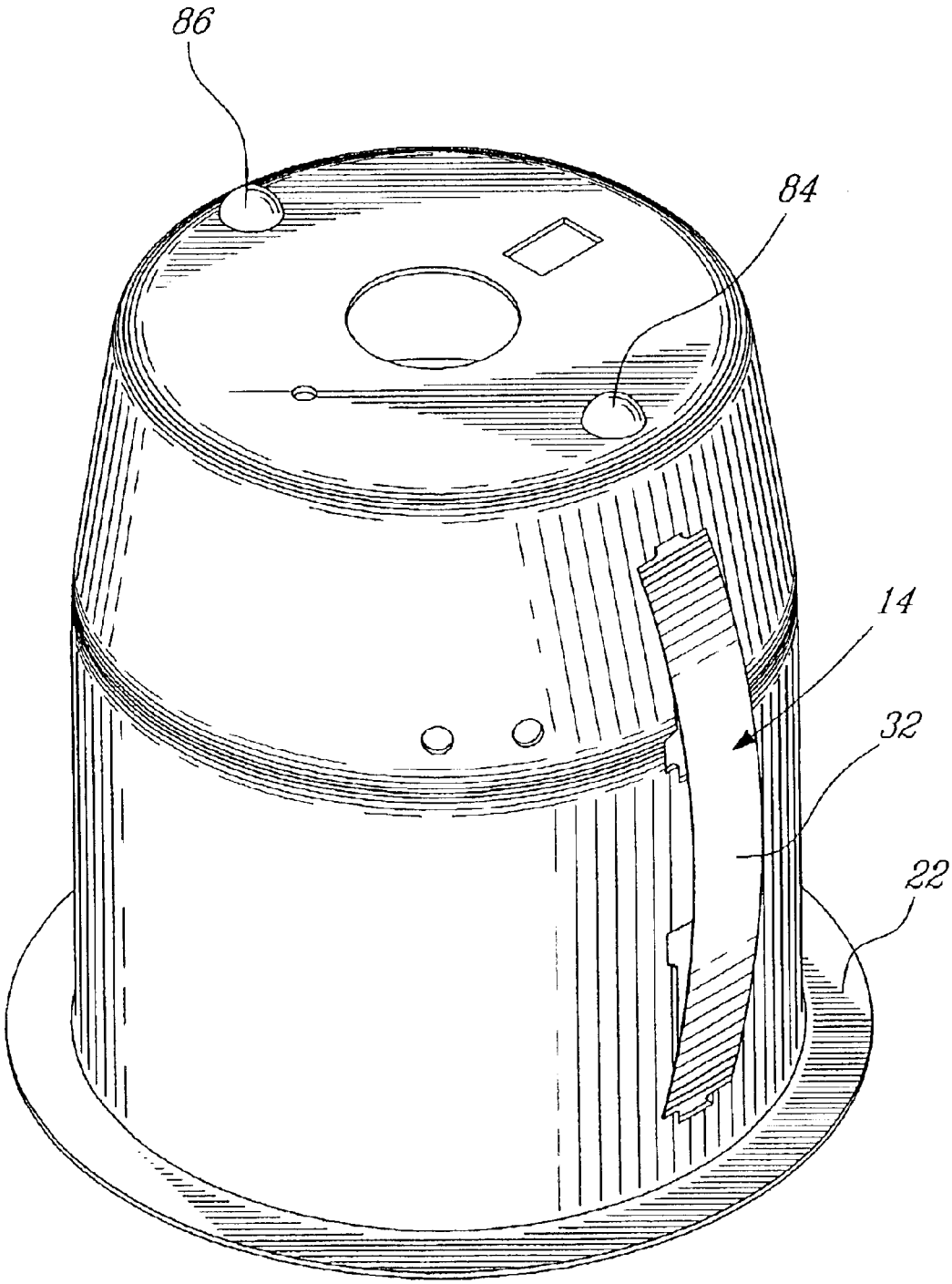
FIG. 2 is a perspective view of the pot shown in FIG. 1 showing the retaining clip in an unflexed condition.

Referring to FIG. 1, there is shown a recessed light fixture, generally denoted 10, consisting of a pot 12 and a pair of diametrically opposite retaining clips 14 and 16. The retaining clips 14 and 16 being identical, a description of one only will be given.

The pot 12 has a rear or inner wall 18 and a side wall 20 displaying a lower peripheral flange 22 which is adapted to contact the front surface 24 (see FIG. 4) of a ceiling, wall or the like 26. The side wall 20 displays, diametrically opposite to one another, a pair of aligned slots 28 and 30 extending in the axial direction of the pot. In the embodiment illustrated, the uppermost slot 28 displays a rectangular shaped opening 28*a* and an enlarged rectangular shaped lower opening 28*b* while the lowermost slot 30 displays a rectangular shaped area 30*a* and a slightly enlarged upper area 30*b*.

Figure 5:
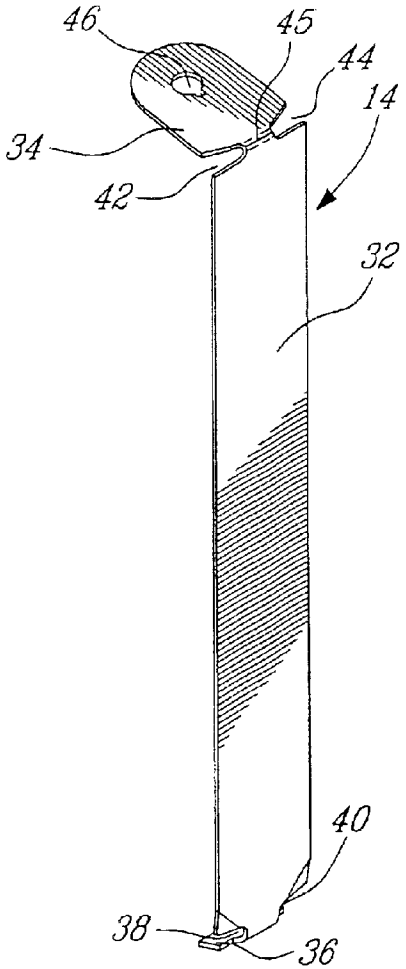
FIG. 5 is a perspective view showing the retaining clip.

Referring to FIG. 5, the retaining clip 14 comprises an elongated body having a main longitudinal portion 32, an upper bent connecting portion 34 and a lower portion 36 displaying opposite recesses 38 and 40. A pair of opposite recesses 42 and 44 are defined at the elbow portion 45 of the clip. The upper end portion 34 displays a threaded hole 46, the function of which will be given hereinafter.

Figure 3:
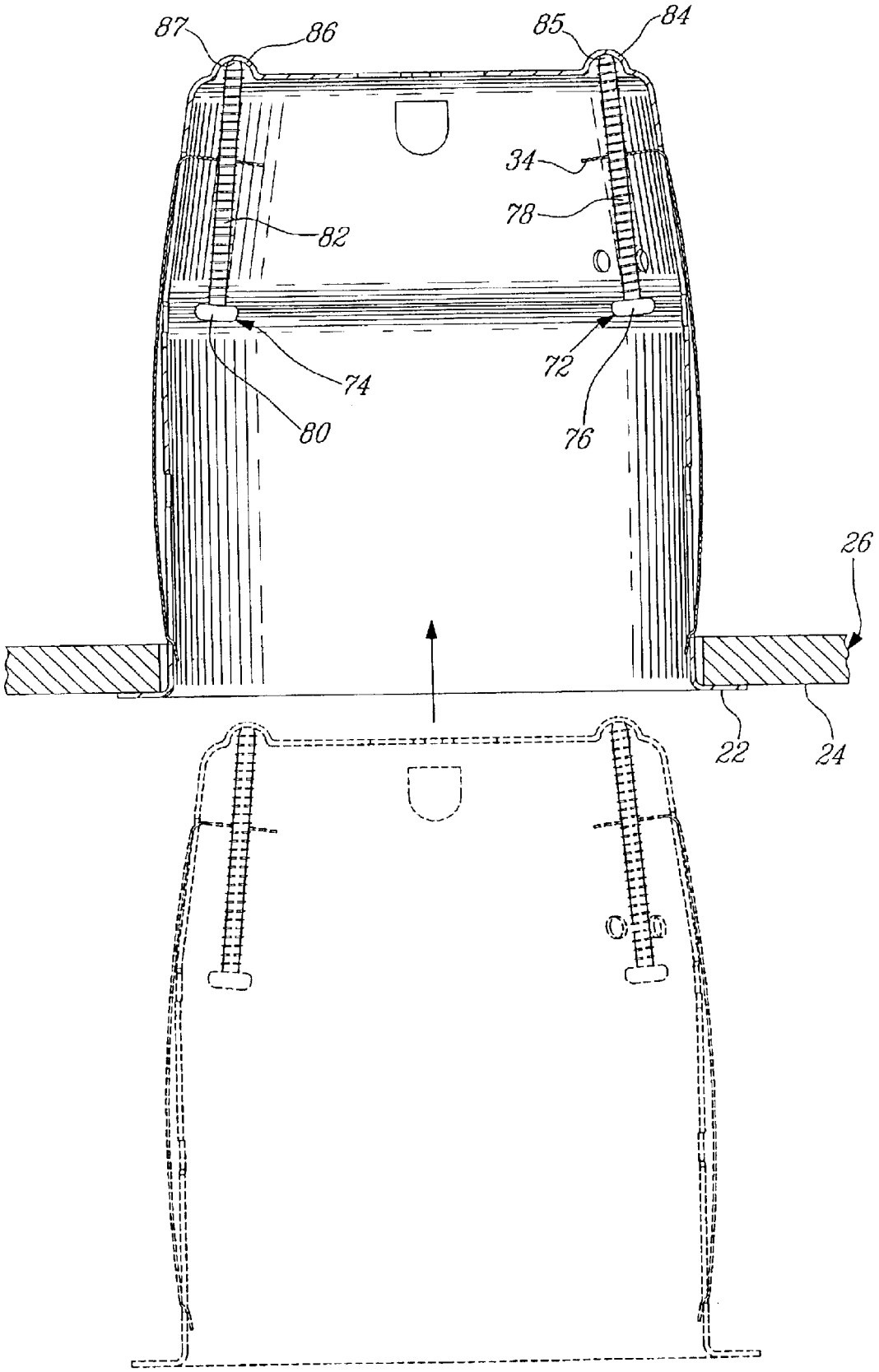

As seen in FIG. 1, the upper slot 28*a* of the pot has a width slightly greater than the elbow portion 45 of the clip so that it may slide vertically along the slot 28, while the adjacent parts of the clip at recesses 42 and 44 slide along the wall 20 of the pot. The width of the enlarged area 28*b* of the upper slot is slightly greater than the width of the upper connecting portion 34 of the clip to enable transverse insertion of the connecting portion 34 in and out of this opening 28*b*. Similarly, the width of the slot portion 30*a* of the lower slot 30 is slightly larger than the width between the opposite recesses 38 and 40 so that the lower end portion of the clip may slide vertically along the wall 20 in the slot 30. The width of the upper area 30*b* of the lower slot 30 is slightly larger than the width of the lower end 36 so that the latter can be moved transversally in and out of the slot area 30*b*. The installation of the retaining clip to the pot shown will now be described with reference to FIG. 3.

First, the upper end connecting portion 34 of each clip is inserted into the enlarged area 28*b* and the clip is slipped upwards until the lower end portion 36 of the clip faces the enlarged area opening 30*b* of the pot wall. The clip is then flexed so that the portion 36 of the clip may fit into the opening 30*b*. The pot with the clips may be inserted into a hole made in the wall 26. Once the pot is inserted, the flange 22 of the pot contacts the outer surface 24 of the wall 26.

A pair of bolts 72 and 74, each having a head 76, 80 and a threaded stem 78, 82 are inserted in the pot with the threaded stems 78 and 82 engaging through a corresponding threaded opening 46 of the upper end portion 34 of the clip. The inner wall 18 of the pot may have two rounded concavities 84 and 86 to receive the upper extremities 85 and 87 of the bolts 72 and 74.

With the assistance of a screw driver which engages the heads 76 and 80 of the bolts, rotation is applied causing the upper connecting portions 34 of the clips to axially move alone the threaded stems (bolts 72 and 74 do not move axially due to their extremities 85 and 87 contacting the inner wall 18 of the pot). The downward motion of the clip portions 34 causes the clip portion 32 to flex outwardly since its lower edge 36 bias against the lower edge of slot 30.

Figure 4:
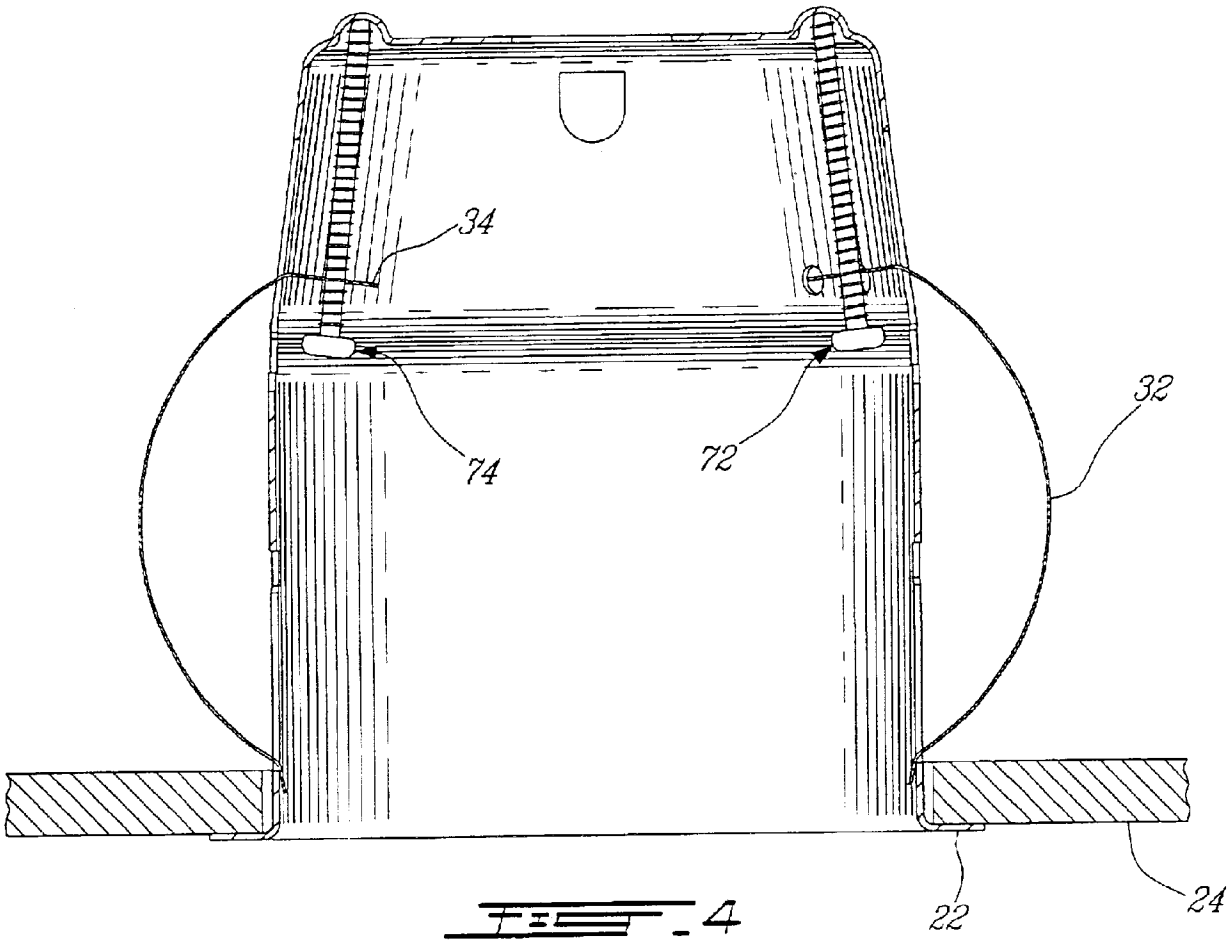
FIG. 4 is a cross-sectional view showing the fixation of the light fixture and illustrating the actuation of the retaining clips.

As can be seen in FIG. 4, in the flexed position, the clip prevents the pot from moving out of the wall opening and the post is thereby secured to the wall.

Preferably, the clip is made of metallic material in order to provide the required flexing action of the clip portion 32.

Although the invention has been described above with respect to a specific form, it will be evident to the person skilled in the art that it may be refined and modified in various ways. For example, although the slot means consist of a pair of aligned slots, a single slot could. It is therefore wished to have it understood that the present invention should not be limited in an interpretation except by the terms of the following claims.

What is claimed is:

1. A recessed light fixture for mounting into an opening made in a ceiling, wall defining a front wall surface and a rear wall surface, said fixture comprising:

a) a pot adapted to be received in said opening; said pot having an inner rear wall and a side wall; said side wall having an outer peripheral flange adapted to bear against said front wall surface when mounted in said opening; said side wall displaying slot means therethrough;

b) retaining clip means consisting of an elongated flexible body having i) a main portion adapted to lie exteriorly along said side wall;

ii) an upper connecting portion extending substantially parallel to said inner rear wall of said pot and through said slot means; said upper connecting portion displaying a threaded hole therethrough;

iii) a lower portion extending through said slot means; said lower portion engaging a lower extremity of said slot means and having a lower edge adapted to contact said side wall of said pot;

c) an adjusting bolt having a head and an elongated threaded stem adapted to extend through said threaded hole of said upper connecting portion of said clip means and to contact said rear wall of said pot:

wherein rotation of said bolt causes said upper connecting portion of said clip means to move longitudinally relative to said side wall in said slot means and said main portion to flexidly bend and unbend in accordance with respective rotational actuation of said bolt to secure and unsecure said pot in said pot in said ceiling, wall or the like.

2. A light fixture as defined in claim 1, wherein said slot means consist of two vertically spaced slots.

3. A light fixture as defined in claim 2, wherein a lowermost of said slots defines a rectangular shaped opening; said opening having an enlarged entrance area for said lower portion of said clip means.

4. A light fixture as defined in claim 2, wherein an uppermost of said slots defines a rectangular shaped opening; said opening having an enlarged entrance area for said upper connecting portion of said clip means.

5. A light fixture as defined in claim 1, said rear wall of said pot displays a recessed area to receive an upper extremity of said bolt.

6. A light fixture as defined in claim 1, wherein said clip means consist of a pair of clips disposed diametrically opposite to one another on said side wall of said pot.

7. A light fixture as defined in claim 1, wherein said clip is made of metallic material.

* * * * *